US007144188B1

(12) United States Patent
Mallinson et al.

(10) Patent No.: US 7,144,188 B1
(45) Date of Patent: Dec. 5, 2006

(54) IMPACT-ABSORBING BARRIER ASSEMBLY

(76) Inventors: Cyrus J. Mallinson, 1311 Manor St., Kalamazoo, MI (US) 49006; Carol A. Mallinson, 1311 Manor St., Kalamazoo, MI (US) 49006

( * ) Notice: Subject to any disclaimer, the term of this patent is extended or adjusted under 35 U.S.C. 154(b) by 0 days.

(21) Appl. No.: 11/327,775

(22) Filed: Jan. 9, 2006

(51) Int. Cl.
*E01F 13/00* (2006.01)

(52) U.S. Cl. ..... 404/6

(58) Field of Classification Search ..... 404/6, 404/10; 256/1, 13.1
See application file for complete search history.

(56) References Cited

U.S. PATENT DOCUMENTS

| | | | | |
|---|---|---|---|---|
| 4,681,302 | A | 7/1987 | Thompson | |
| 4,869,617 | A | 9/1989 | Chiodo | |
| 4,946,306 | A | 8/1990 | Yodock | |
| 5,022,781 | A * | 6/1991 | Smith | 404/6 |
| 5,123,773 | A | 6/1992 | Yodock | |
| 5,208,585 | A | 5/1993 | Sprague | |
| RE34,691 | E | 8/1994 | White | |
| 5,336,016 | A * | 8/1994 | Baatz | 404/6 |
| 5,437,907 | A | 8/1995 | Peil et al. | |
| 5,498,101 | A * | 3/1996 | Braverman | 404/6 |
| 5,509,249 | A * | 4/1996 | House et al. | 52/745.1 |
| D385,362 | S | 10/1997 | Rossetti | |
| 6,666,616 | B1 * | 12/2003 | Yodock et al. | 404/6 |
| 6,863,468 | B1 * | 3/2005 | Davis et al. | 404/6 |
| 6,926,461 | B1 * | 8/2005 | Faller et al. | 404/6 |
| 6,951,434 | B1 * | 10/2005 | Yodock et al. | 404/6 |
| 2003/0081998 | A1 | 5/2003 | Yodock, III et al. | |
| 2005/0201828 | A1 * | 9/2005 | Kang | 404/6 |

* cited by examiner

*Primary Examiner*—Gary S. Hartmann

(57) ABSTRACT

A barrier assembly includes first, second and third bodies that are vertically stacked. Each body includes a top surface and side surfaces. Inlet ports are formed within the top surfaces. Isolated chambers are formed within and are equidistantly spaced from a center of each body. The bodies include opposed ends that have serrations formed therewith that are interfitted for inhibiting lateral movement of the bodies during collision. The bodies also include indentations formed therein for receiving a user's hands or a fork lift arm, and assisting the user to transport the bodies. Reinforcement rods, formed from non-corrosive material, traverse through the bodies. At least one reinforcement rod is medially seated between the isolated compartments for counterbalancing a combined weight of the bodies. A connector rod is conjoined to the bodies such that the bodies are prohibited from disengaging while experiencing an impact force.

15 Claims, 5 Drawing Sheets

IMPACT-ABSORBING BARRIER ASSEMBLY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to barrier assemblies and, more particularly, to an impact-absorbing barrier assembly for absorbing and dissipating impact energy generated by a vehicle during a collision.

2. Prior Art

With the extensive system of highways in the United States, repair, reconstruction, and new construction are an on-going process. Work-zone safety (especially on the high-speed interstate highways) is a continuing concern. This has been illustrated by the increase in fines and penalties levied by state governments for motorists not observing reduced speed and other safety related protections in construction zones.

Throughout the highway system, various signs, cones, barrels, and other guidance devices serve a variety of needs. Especially on the interstate highways, one often used device is the cement longitudinal barrier. Typically, these barriers are approximately ten feet long, two feet wide at the bottom, 10 to 12 inches wide at the top and three to four feet tall. They are constructed with some type of attaching device on each end so that, when placed in a long line, they can be joined together.

When placed end-to-end they can often extend for miles. One key purpose of this practice is to provide a channel for traffic through work-zone areas, around bridge work and to enable traffic redirection when a nonstandard pattern of road use is temporarily in place. A second key purpose is to provide a safety barrier between construction workers and the moving flow of traffic on the roadway. While these cement barriers have been used for many years on roadways from local streets to interstate highways, they have several inherent limitations.

First, being constructed of cement, they are the same light gray color as the surrounding road surfaces, bridges and retaining walls. As a result, when motorists approach a work zone, it is difficult to see how traffic is being redirected until the motorist is actually in the zone. This is true even with rubber barrel, "sawhorse" or other types of guidance devices. The barriers are difficult to see.

Second, cement barriers are very heavy. To set them up in a work zone requires a large overhead crane or some other heavy duty lifting machinery. During the time they are being installed the danger is even greater to motorists and construction workers. The crane, heavy duty trucks and trailers needed to transport the barriers, and the always possible collision of a vehicle and the crane when a barrier is suspended is ever present.

A third danger occurs during the dark night hours, when these barriers are most frequently employed. Often the barriers are marked with only a standard reflector. When driving past a line of barriers the motorist has the "flashbulbs popping in the eyes" effect from seeing these reflectors in rapid succession. This is especially bad when it occurs away from the illumination of street lights or general city lighting.

Accordingly, a need remains for an impact-absorbing barrier assembly in order to overcome the above-noted shortcomings. The present invention satisfies such a need by providing a barrier assembly that is easily installed, adaptable in nature, highly visible in during day- and night-time hours, very effective in application, and greatly increases the safety of motorists and construction workers alike. Such a barrier assembly is employable on a wide variety of road ways, ranging from local roads to interstate highways, which currently employ the more convention cement barriers. The hollow plastic, modular design eliminates the need for a crane in order to install the barrier, which greatly reduces the amount of time and costs associated with installing such barriers. The continuous reflective surface and the bright colors of the barrier outer surface, endows the assembly with superior visibility over conventional barriers, especially at night and during inclement weather conditions.

BRIEF SUMMARY OF THE INVENTION

In view of the foregoing background, it is therefore an object of the present invention to provide an impact-absorbing barrier assembly. These and other objects, features, and advantages of the invention are provided by a barrier assembly for effectively absorbing and advantageously dissipating impact energy generated by a vehicle during a collision.

The barrier assembly includes a first body, a second body and a third body vertically stacked along a uniform pattern. Each of the first, second and third bodies include a fixed longitudinal length provided with a centrally registered longitudinal axis situated parallel to a support surface onto which the first body is disposed during operating conditions. The first, second and third bodies further include substantially planar top surfaces and a pair of side surfaces equidistantly offset from the longitudinal axis, respectively. Such a pair of side surfaces are oriented orthogonal to the longitudinal axis.

A plurality of inlet ports are monolithically formed within the top surface of the first, second and third bodies, and are equidistantly spaced therealong. A plurality of coextensively shaped and isolated chambers are formed therein and are equidistantly spaced from a center of the first, second and third bodies respectively.

The first, second and third bodies further include axially opposed ends that have a plurality of serrations monolithically formed therewith. Such serrations are removably interfitted for effectively providing increased surface contact friction and for advantageously inhibiting lateral movement of the first, second and third bodies during collision.

The first, second and third bodies also include a plurality of indentations monolithically formed therein. Such indentations are suitably sized and shaped for receiving a user's hands directly therein and advantageously assisting the user to transport the first, second and third bodies between remote locations. The indentations are suitably sized and shaped for receiving a fork lift arm therethrough such that the first, second and third bodies can conveniently be readily transported between remote locations.

A plurality of reinforcement rods traverse through the first, second and third bodies wherein the reinforcement rods are aligned perpendicular to the longitudinal axis. Such rods are formed from non-corrosive material. At least one of the reinforcement rods is medially seated between the isolated compartments for effectively counterbalancing a combined weight of the first, second and third bodies respectively. Each reinforcement rod may be partially inserted into the support surface for effectively anchoring the first, second and third bodies to the support surface.

A connector rod is directly conjoined to the first, second and third bodies in such a manner that the first, second and third bodies are advantageously prohibited from disengaging after an external force impacts the assembly. Each of the first, second and third bodies may further include a pair of axially spaced flange portions that are directly conjoined to the opposed end portions of the first, second and third bodies respectively. The connector rod is slidably traversed through the flange portions in such a manner that the first, second and third bodies advantageously and effectively become statically linked and disposed at an end-to-end arrangement.

The assembly preferably further includes a predetermined quantity of liquid housed within the chambers for effectively weighing down the first, second and third bodies and absorbing the impact force during the collision. The assembly may also include a reflective layer that is directly affixed to the top surfaces and the side surfaces of at least one of the first, second and third bodies for advantageously providing better visibility to a driver during inclement lighting conditions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
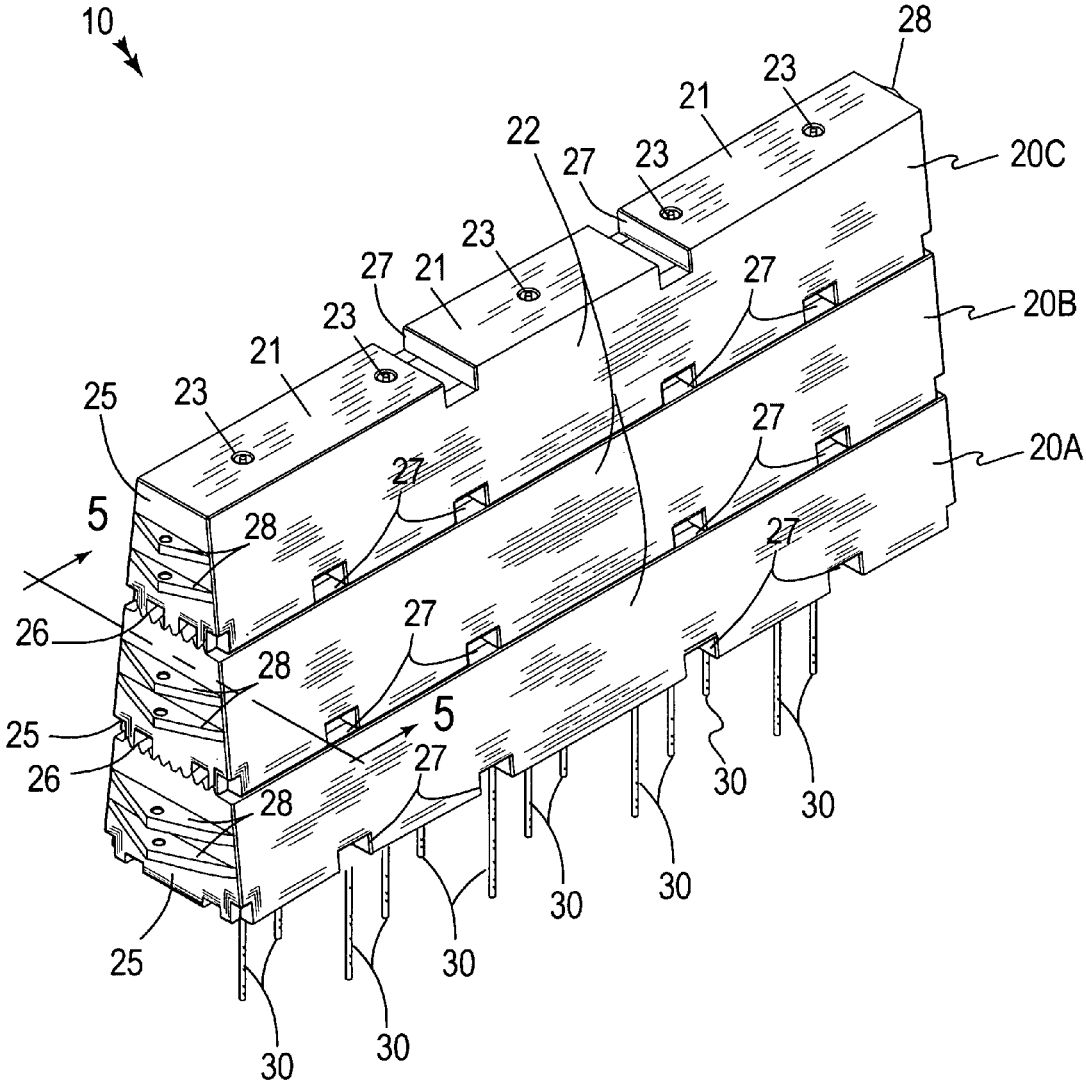
FIG. 1 is a perspective view showing an impact-absorbing barrier assembly, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1–5 by the reference numeral 10 and is intended to provide an impact-absorbing barrier assembly. It should be understood that the assembly 10 may be used to provide a barrier in many different types of situations and should not be limited in use to only road-side construction sites.

Figure 2:
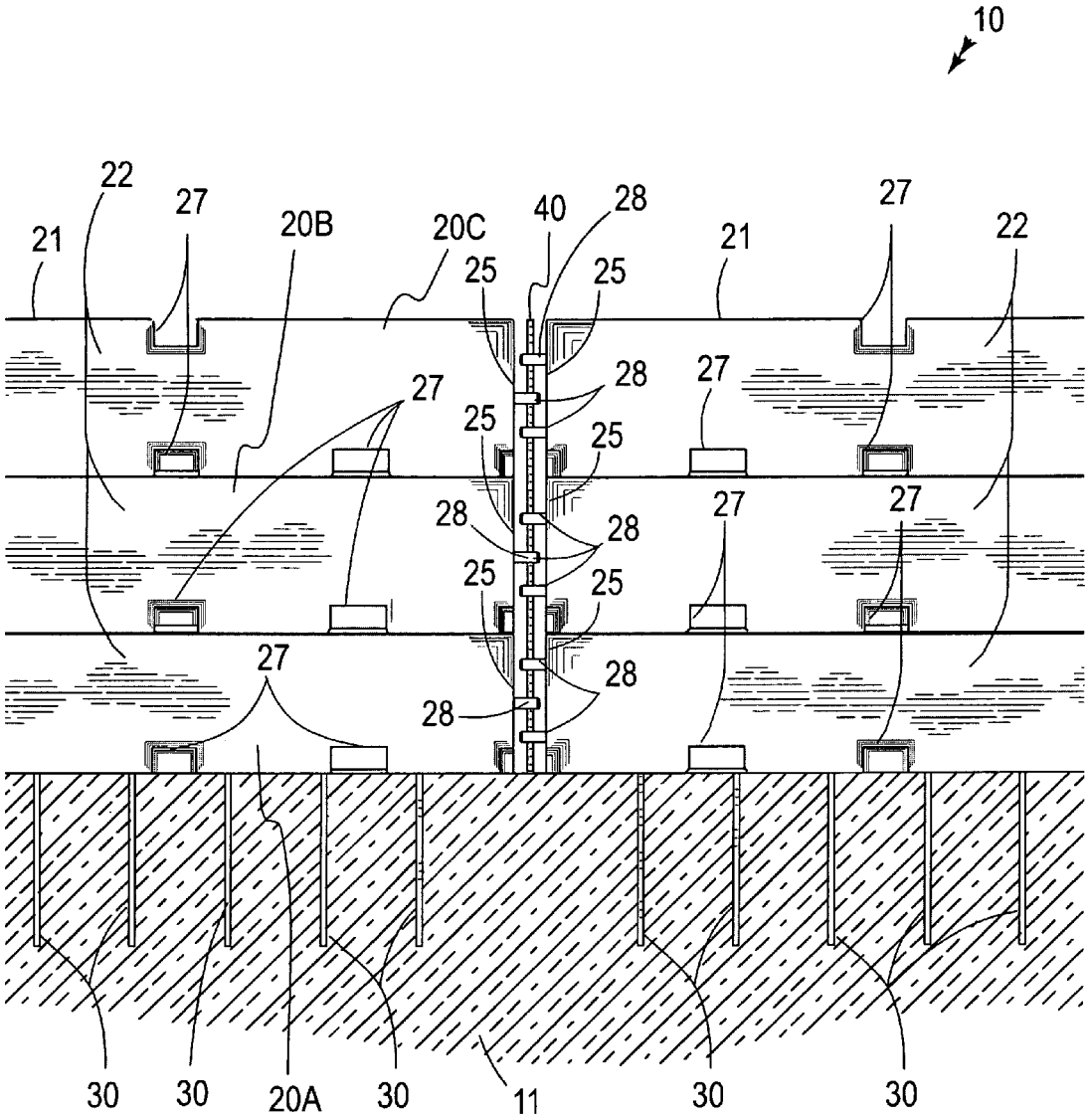
FIG. 2 is a front-elevational view of the assembly shown in FIG. 1.

Referring initially to FIGS. 1 through 5, the assembly 10 includes a first body 20A, a second body 20B and a third body 20C vertically stacked along a uniform pattern. Of course, the assembly 10 may be vertically stacked with more or less than three bodies 20, as is obvious to a person of ordinary skill in the art. Each of the first 20A, second 20B and third 20C bodies include a fixed longitudinal length provided with a centrally registered longitudinal axis situated parallel to a support surface 11 onto which the first body 20A is disposed during operating conditions, as is best shown in FIG. 2. The first 20A, second 20B and third 20C bodies further include substantially planar top surfaces 21 and a pair of side surfaces 22 equidistantly offset from the longitudinal axis, respectively. Such a pair of side surfaces 22 are oriented orthogonal to the longitudinal axis. Of course, the bodies 20 may be produced in a variety of lengths, heights, widths and colors, as is obvious to a person of ordinary skill in the art.

Figure 3:
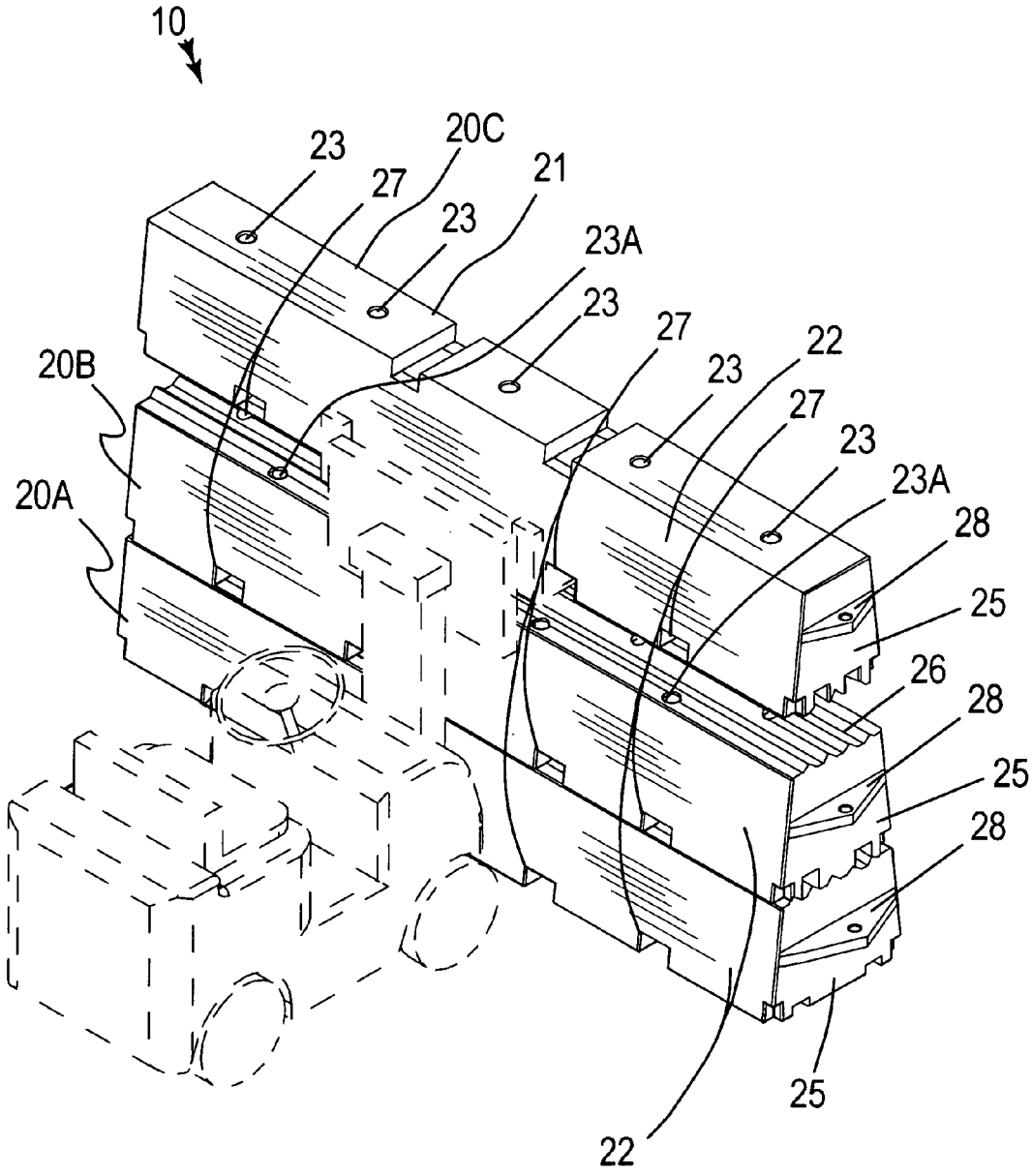
FIG. 3 is a perspective view of the assembly shown in FIG. 1, showing same being transported by a fork lift.
Figure 5:
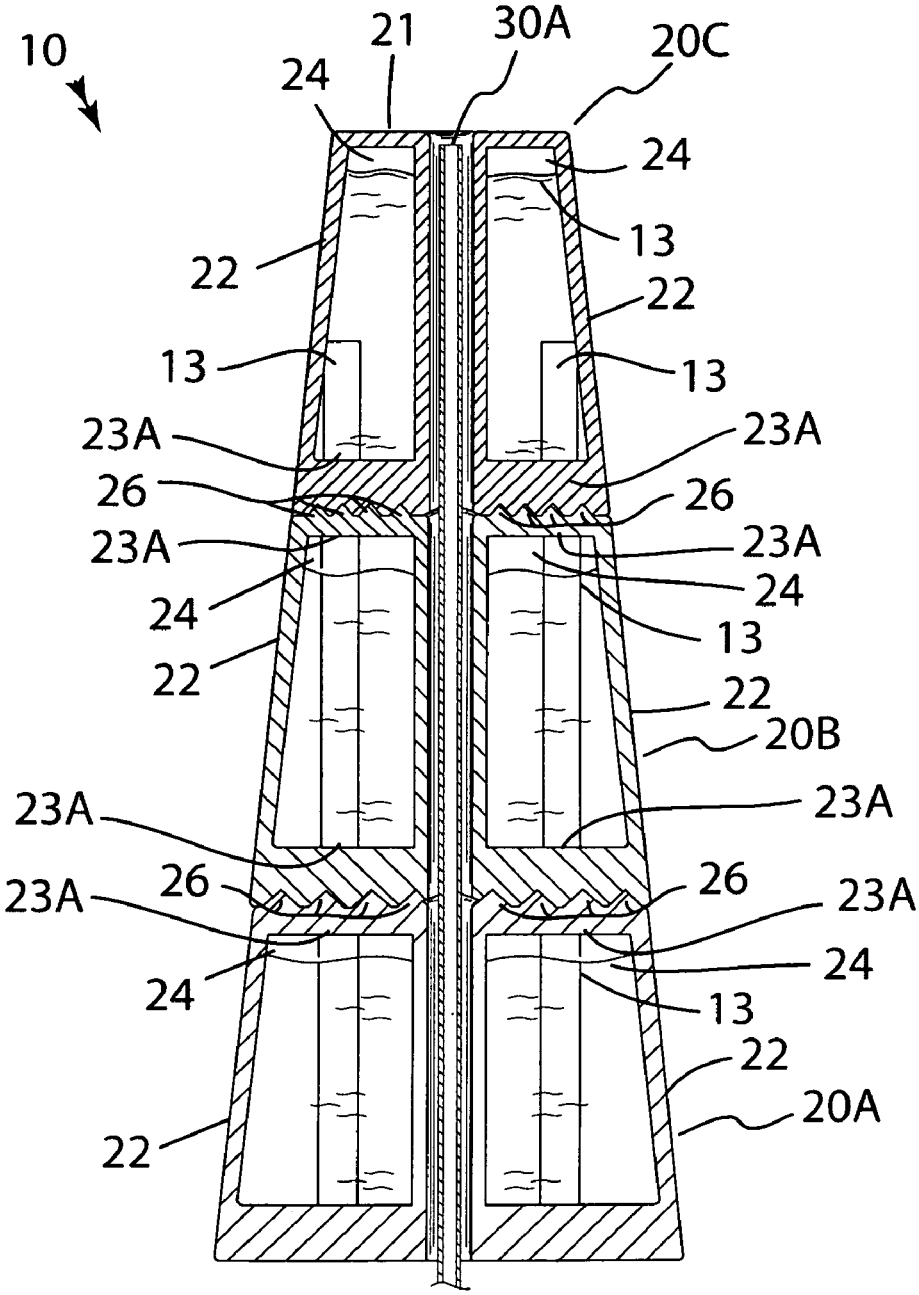
FIG. 5 is a cross-sectional view of the assembly show in FIG. 1, showing the isolated and fluid filled chambers within each body.

Referring to FIGS. 1, 3 and 5, a plurality of inlet ports 23 are monolithically formed within the top surface 21 of the first 20A, second 20B and third 20C bodies, and are equidistantly spaced therealong. Such inlet ports 23 are preferably spaced along a center of the first 20A, second 20B and third 20C bodies, respectively. An additional eight inlet ports 23A are provided along outer edges of the bodies 20A–C for channeling support rods 13 through the first 20A, second 20B and third 20C bodies wherein the rods 13 completely pass through the first 20A and second 20B bodies while terminating approximately midway through the third 20C body, as best shown in FIG. 5. A plurality of coextensively shaped and isolated chambers 24 are formed therein and are equidistantly spaced from a center of the first 20A, second 20B and third 20C bodies respectively, as is best shown in FIG. 5. Such chambers 24 advantageously allow the assembly 10 to be lightweight when the chambers 24 are not at a filled state, thus allowing the bodies 20 to be easily manipulated and transported by hand.

Referring to FIGS. 1, 3, 4 and 5, the first 20A, second 20B and third 20C bodies further include axially opposed ends 25 that have a plurality of serrations 26 monolithically formed therewith. Such serrations 26 are removably interfitted, which is essential for effectively providing increased surface contact friction and for advantageously inhibiting lateral movement of the first 20A, second 20B and third 20C bodies during a collision.

Figure 4:
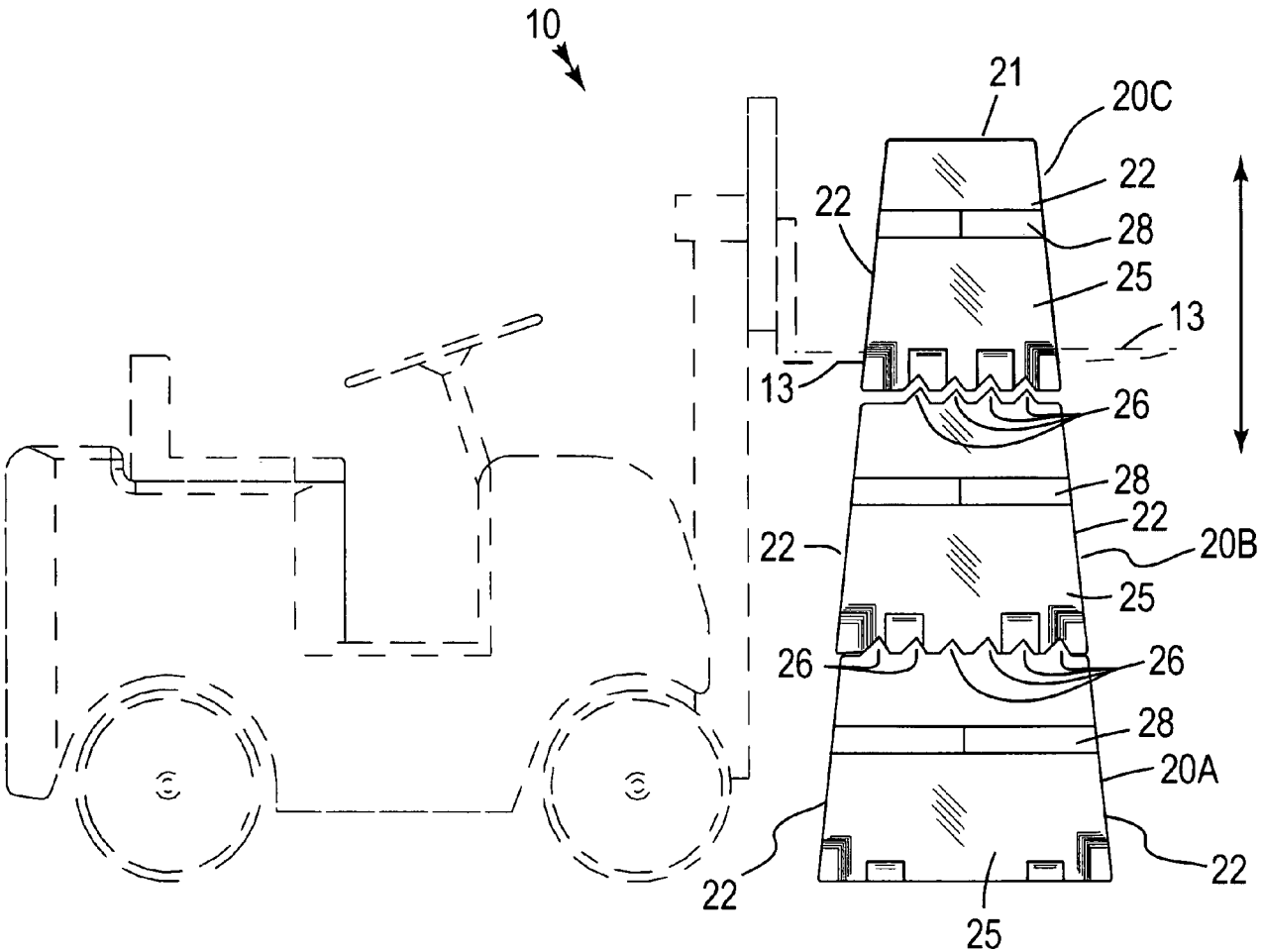
FIG. 4 is a side-elevational view of the assembly shown in FIG. 3.

Referring to FIGS. 1 through 3, the first 20A, second 20B and third 20C bodies also include a plurality of indentations 27 monolithically formed therein. Such indentations 27 are suitably sized and shaped for receiving a user's hands directly therein, without the use of intervening elements, and advantageously assisting the user to transport the first 20A, second 20B and third 20C bodies between remote locations. The indentations 27 are also suitably sized and shaped for receiving a fork lift arm 12 therethrough, which is crucial and advantageous such that the first 20A, second 20B and third 20C bodies can conveniently be readily transported between remote locations, as is best shown in FIGS. 3 and 4.

Referring to FIGS. 1, 2 and 5, a plurality of reinforcement rods 30 traverse through the first 20A, second 20B and third 20C bodies wherein the reinforcement rods 30 are aligned perpendicular to the longitudinal axis. Such rods 30 are formed from non-corrosive material, which is a vital and advantageous feature for allowing the assembly 10 to be employed in adverse and moist weather conditions. At least one 30A of the reinforcement rods 30 is medially seated between the isolated chambers 24, which is important for effectively counterbalancing a combined weight of the first 20A, second 20B and third 20C bodies respectively. Each reinforcement rod 30 is partially inserted into the support surface 11 for effectively anchoring the first 20A, second 20B and third 20C bodies to the support surface 11.

Referring to FIG. 2, a connector rod 40 is directly conjoined, without the use of intervening elements, to the first 20A, second 20B and third 20C bodies in such a manner that the first 20A, second 20B and third 20C bodies are advantageously prohibited from disengaging after an external force impacts the assembly. Each of the first 20A, second 20B and third 20C bodies further includes a pair of axially spaced flange portions 28 that are directly conjoined, without the use of intervening elements, to the opposed ends 25 of the first 20, second and third bodies respectively. The connector rod 40 is slidably traversed through the flange portions 28 in such a manner that the first 20A, second 20B and third 20C bodies advantageously and effectively become statically linked and disposed at an end-to-end arrangement.

Referring to FIGS. 1 and 5, the assembly 10 further includes a predetermined quantity of liquid 13 housed within the chambers 24, which is crucial for effectively weighing down the first 20A, second 20B and third 20C bodies and absorbing the impact force during the collision. The assembly 10 also includes a reflective layer 50 that is directly affixed, without the use of intervening elements, to the top surfaces 21 and the side surfaces 22 of at least one of the first 20A, second 20B and third 20C bodies, which is a vital feature for advantageously providing better visibility to a driver during inclement lighting conditions.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A barrier assembly for absorbing and dissipating impact energy generated by a vehicle during a collision, said barrier assembly comprising:

a first body and a second body and a third body vertically stacked along a uniform pattern, each said first, second and third bodies comprising a fixed longitudinal length provided with a centrally registered longitudinal axis situated parallel to a support surface onto which said first body is disposed during operating conditions, a substantially planar top surface and a pair of side surfaces equidistantly offset from said longitudinal axis, said pair of side surfaces being oriented orthogonal to said longitudinal axis, a plurality of inlet ports monolithically formed within said top surface and equidistantly spaced therealong, a plurality of coextensively shaped and isolated chambers formed therein and equidistantly spaced from a center of said first, second and third bodies respectively, axially opposed ends having a plurality of serrations monolithically formed therewith, said serrations being removably interfitted for providing increased surface contact friction and for inhibiting lateral movement of said first, second and third bodies during collision, a plurality of indentations monolithically formed therein, said indentations being suitably sized and shaped for receiving user hands directly therein and assisting the user to transport said first, second and third bodies between remote locations;

a plurality of reinforcement rods traversing through said first, second and third bodies wherein said reinforcement rods are aligned perpendicular to said longitudinal axis, said rods being formed from non-corrosive material; and a connector rod directly conjoined to said first, second and third bodies in such a manner that said first, second and third bodies are prohibited from disengaging after an external force impacts said assembly.

2. The assembly of claim 1, wherein each said first, second and third bodies further comprise;

a pair of axially spaced flange portions directly conjoined to said opposed end portions of said first, second and third bodies respectively, said connector rod being slidably traversed through said flange portions in such a manner that said first, second and third bodies become statically linked and disposed at an end-to-end arrangement.

3. The assembly of claim 1, wherein each said reinforcement rods are partially inserted into the support surface for effectively anchoring said first, second and third bodies to the support surface.

4. The assembly of claim 1, further comprising: a predetermined quantity of liquid housed within said chambers for weighing down said first, second and third bodies and absorbing the impact force during the collision.

5. The assembly of claim 1, further comprising: a reflective layer directly affixed to at least one said top surface and said side surfaces of at least one of said first, second and third bodies for providing better visibility to a driver during inclement lighting conditions.

6. A barrier assembly for absorbing and dissipating impact energy generated by a vehicle during a collision, said barrier assembly comprising:

a first body and a second body and a third body vertically stacked along a uniform pattern, each said first, second and third bodies comprising a fixed longitudinal length provided with a centrally registered longitudinal axis situated parallel to a support surface onto which said first body is disposed during operating conditions, a substantially planar top surface and a pair of side surfaces equidistantly offset from said longitudinal axis, said pair of side surfaces being oriented orthogonal to said longitudinal axis, a plurality of inlet ports monolithically formed within said top surface and equidistantly spaced therealong, a plurality of coextensively shaped and isolated chambers formed therein and equidistantly spaced from a center of said first, second and third bodies respectively, axially opposed ends having a plurality of serrations monolithically formed therewith, said serrations being removably interfitted for providing increased surface contact friction and for inhibiting lateral movement of said first, second and third bodies during collision, a plurality of indentations monolithically formed therein, said indentations being suitably sized and shaped for receiving user hands directly therein and assisting the user to transport said first, second and third bodies between remote locations, wherein said indentations are suitably sized and shaped for receiving a fork lift arm therethrough such that said first, second and third bodies can be readily transported between remote locations;

a plurality of reinforcement rods traversing through said first, second and third bodies wherein said reinforcement rods are aligned perpendicular to said longitudinal axis, said rods being formed from non-corrosive material; and a connector rod directly conjoined to said first, second and third bodies in such a manner that said first, second and third bodies are prohibited from disengaging after an external force impacts said assembly.

7. The assembly of claim 6, wherein each said first, second and third bodies further comprise:

a pair of axially spaced flange portions directly conjoined to said opposed end portions of said first, second and third bodies respectively, said connector rod being slidably traversed through said flange portions in such a manner that said first, second and third bodies become statically linked and disposed at an end-to-end arrangement.

8. The assembly of claim 6, wherein each said reinforcement rods are partially inserted into the support surface for effectively anchoring said first, second and third bodies to the support surface.

9. The assembly of claim 6, further comprising: a predetermined quantity of liquid housed within said chambers for weighing down said first, second and third bodies and absorbing the impact force during the collision.

10. The assembly of claim 6, further comprising: a reflective layer directly affixed to at least one said top surface and said side surfaces of at least one of said first, second and third bodies for providing better visibility to a driver during inclement lighting conditions.

11. A barrier assembly for absorbing and dissipating impact energy generated by a vehicle during a collision, said barrier assembly comprising:

a first body and a second body and a third body vertically stacked along a uniform pattern, each said first, second and third bodies comprising a fixed longitudinal length provided with a centrally registered longitudinal axis situated parallel to a support surface onto which said first body is disposed during operating conditions, a substantially planar top surface and a pair of side surfaces equidistantly offset from said longitudinal axis, said pair of side surfaces being oriented orthogonal to said longitudinal axis, a plurality of inlet ports monolithically formed within said top surface and equidistantly spaced therealong, a plurality of coextensively shaped and isolated chambers formed therein and equidistantly spaced from a center of said first, second and third bodies respectively, axially opposed ends having a plurality of serrations monolithically formed therewith, said serrations being removably interfitted for providing increased surface contact friction and for inhibiting lateral movement of said first, second and third bodies during collision, a plurality of indentations monolithically formed therein, said indentations being suitably sized and shaped for receiving user hands directly therein and assisting the user to transport said first, second and third bodies between remote locations, wherein said indentations are suitably sized and shaped for receiving a fork lift arm therethrough such that said first, second and third bodies can be readily transported between remote locations;

a plurality of reinforcement rods traversing through said first, second and third bodies wherein said reinforcement rods are aligned perpendicular to said longitudinal axis, said rods being formed from noncorrosive material, wherein at least one of said reinforcement rods is medially seated between said isolated compartments for counterbalancing a combined weight of said first, second and third bodies respectively; and a connector rod directly conjoined to said first, second and third bodies in such a manner that said first, second and third bodies are prohibited from disengaging after an external force impacts said assembly;

wherein said connector rod has a bottom end seated directly above the ground surface wherein each of said reinforcement rods have a bottom end seated directly on a respective bottom surface of said first body and further have a top end respectively abutted directly against a laterally positioned inner wall of said hollow chamber of said third body respectively.

12. The assembly of claim 11, wherein each said first, second and third bodies further comprise:

a pair of axially spaced flange portions directly conjoined to said opposed end portions of said first, second and third bodies respectively, said connector rod being slidably traversed through said flange portions in such a manner that said first, second and third bodies become statically linked and disposed at an end-to-end arrangement.

13. The assembly of claim 11, wherein each said reinforcement rods are partially inserted into the support surface for effectively anchoring said first, second and third bodies to the support surface.

14. The assembly of claim 11, further comprising: a predetermined quantity of liquid housed within said chambers for weighing down said first, second and third bodies and absorbing the impact force during the collision.

15. The assembly of claim 11, further comprising: a reflective layer directly affixed to at least one said top surface and said side surfaces of at least one of said first, second and third bodies for providing better visibility to a driver during inclement lighting conditions.

* * * * *